US012736060B2

(12) United States Patent
Magara et al.

(10) Patent No.: US 12,736,060 B2
(45) Date of Patent: Sep. 15, 2026

(54) CAUSE-OF-ANOMALY ESTIMATION DEVICE FOR FLUID MACHINE, CAUSE-OF ANOMALY ESTIMATION METHOD THEREFOR, AND CAUSE-OF-ANOMALY ESTIMATION SYSTEM FOR FLUID MACHINE

(71) Applicant: Hitachi Industrial Products, Ltd., Tokyo (JP)

(72) Inventors: Yohei Magara, Tokyo (JP); Masaki Kanada, Tokyo (JP); Takayasu Kasahara, Tokyo (JP); Naohiko Takahashi, Tokyo (JP); Kohei Nishida, Tokyo (JP)

(73) Assignee: Hitachi Industrial Products, Ltd., Tokyo (JP)

( * ) Notice: Subject to any disclaimer, the term of this patent is extended or adjusted under 35 U.S.C. 154(b) by 296 days.

(21) Appl. No.: 18/715,870

(22) PCT Filed: Oct. 7, 2022

(86) PCT No.: PCT/JP2022/037635
§ 371 (c)(1),
(2) Date: Jun. 3, 2024

(87) PCT Pub. No.: WO2023/105908
PCT Pub. Date: Jun. 15, 2023

(65) Prior Publication Data

US 2025/0035123 A1 Jan. 30, 2025

(30) Foreign Application Priority Data

Dec. 9, 2021 (JP) ..... 2021-200117

(51) Int. Cl.
*F04D 27/00* (2006.01)
*F04D 17/12* (2006.01)

(52) U.S. Cl.
CPC ..... *F04D 27/001* (2013.01); *F04D 17/12* (2013.01)

(58) Field of Classification Search
CPC ..... F04D 27/001
See application file for complete search history.

(56) References Cited

U.S. PATENT DOCUMENTS 10,662,959 B2 * 5/2020 Abrol ..... F04D 29/522
11,527,987 B2 * 12/2022 Inoue ..... F04D 27/0292
(Continued)

FOREIGN PATENT DOCUMENTS

JP 63-169536 A 7/1988
JP 4-188307 A 7/1992
(Continued)

OTHER PUBLICATIONS

Extended European Search Report issued in European Application No. 22903842.7 dated Nov. 3, 2025 (11 pages).
(Continued)

*Primary Examiner* — Erika J. Villaluna
(74) *Attorney, Agent, or Firm* — Crowell & Moring LLP

(57) ABSTRACT

In order to obtain a cause-of-anomaly estimation device for a fluid machine that enables simple and convenient, and highly precise estimation of a cause of an anomaly of the fluid machine, the present invention includes: a measurement value input unit to which a measurement value obtained from a sensor installed in the fluid machine is input; a performance calculation unit that calculates the performance of the fluid machine from the measurement value obtained by the measurement value input unit; an anomaly determination unit that determines the presence or absence of an anomaly in the measurement value obtained by the measurement value input unit and in the performance of the fluid machine as calculated by the performance calculation
(Continued)

unit; a cause-of-anomaly estimation unit that estimates a cause of an anomaly of the fluid machine on the basis of a determination result regarding the presence or absence of an anomaly in the performance of the fluid machine as determined by the anomaly determination unit, and a cause of an anomaly of the fluid machine pre-stored in a cause-of-anomaly database; and a results output unit that outputs a cause-of-anomaly estimation result regarding the fluid machine as estimated by the cause-of-anomaly estimation unit.

9 Claims, 7 Drawing Sheets

(56) References Cited

U.S. PATENT DOCUMENTS

| | | | |
|---|---|---|---|
| 2015/0066418 | A1 | 3/2015 | Ceccherini et al. |
| 2015/0220847 | A1 | 8/2015 | Shibuya et al. |
| 2019/0226943 | A1 | 7/2019 | Hayashi et al. |
| 2021/0310727 | A1 | 10/2021 | Satou |

FOREIGN PATENT DOCUMENTS

| | | | |
|---|---|---|---|
| JP | 5-266382 | A | 10/1993 |
| JP | 6-313734 | A | 11/1994 |
| JP | 2003-149043 | A | 5/2003 |
| JP | 2004-279056 | A | 10/2004 |
| JP | 2007-293489 | A | 11/2007 |
| JP | 2015-148867 | A | 8/2015 |
| JP | 2019-128704 | A | 8/2019 |
| WO | WO 2020/067297 | A1 | 4/2020 |

OTHER PUBLICATIONS

International Search Report (PCT/ISA/210) issued in PCT Application No. PCT/JP2022/037635 dated Dec. 13, 2023 with English translation (6 pages).

Japanese-language Written Opinion (PCT/ISA/237) issued in PCT Application No. PCT/JP2022/037635 dated Dec. 13, 2023 with English translation (9 pages).

Japanese-language International Preliminary Report on Patentability (PCT/IPEA/409) issued in PCT Application No. PCT/JP2022/037635 dated Dec. 28, 2023, including Annexes with English translation (33 pages).

* cited by examiner

FIG. 3

| TIME | SHAFT VIBRATION [um] | ・・・ | SUCTION TEMPERA-TURE [°C] | DISCHARGE TEMPERA-TURE [°C] | SUCTION PRESSURE [MPa] | DISCHARGE PRESSURE [MPa] | ROTATION SPEED [$min^{-1}$] | ・・・ |
|---|---|---|---|---|---|---|---|---|
| : | : | : | : | : | : | : | : | : |
| 14:22:00 | 15.1 | | 26 | 189 | 0.3 | 12.1 | 12103 | |
| 14:23:00 | 16 | | 26 | 188 | 0.3 | 12.5 | 12135 | |
| 14:24:00 | 14.5 | | 25 | 192 | 0.3 | 12.6 | 12112 | |
| 14:25:00 | 14.5 | | 25 | 188 | 0.3 | 12.4 | 12129 | |
| 14:26:00 | 15.3 | | 24 | 191 | 0.3 | 12.7 | 12131 | |
| 14:27:00 | 15.7 | | 24 | 190 | 0.3 | 12.5 | 12127 | |
| 14:28:00 | 15.2 | | 25 | 189 | 0.3 | 12.3 | 12118 | |
| : | : | : | : | : | : | : | : | : |

FIG. 4

| SHAFT VIBRATION | ... | AXIAL MOVEMENT | THRUST BEARING TEMPERATURE | ... | SUCTION PRESSURE [MPa] | DISCHARGE PRESSURE [MPa] | ROTATION SPEED [$min^{-1}$] | ... | POLYTROPIC EFFICIENCY |
|---|---|---|---|---|---|---|---|---|---|
| ○ | | | | | | | | | ○ |

○ : ANOMALY

FIG. 5

| CAUSE OF ABNORMALITY | SHAFT VIBRATION | ··· | AXIAL MOVEMENT | THRUST BEARING TEMPERATURE | ··· | SUCTION PRESSURE [MPa] | DISCHARGE PRESSURE [MPa] | ROTATION SPEED [$min^{-1}$] | ··· | POLYTROPIC EFFICIENCY |
|---|---|---|---|---|---|---|---|---|---|---|
| FLOW PATH CONTAMINATION | ○ | | | | | | | | | ○ |
| INTERNAL LEAKAGE | | | ○ | ○ | | | | | | ○ |

○ : ANOMALY

CAUSE-OF-ANOMALY ESTIMATION DEVICE FOR FLUID MACHINE, CAUSE-OF ANOMALY ESTIMATION METHOD THEREFOR, AND CAUSE-OF-ANOMALY ESTIMATION SYSTEM FOR FLUID MACHINE

TECHNICAL FIELD

The present invention relates to a cause-of-anomaly estimation device for a fluid machine such as a compressor that estimates the cause of an anomaly of the fluid machine, a cause-of-anomaly estimation method therefor, and a cause-of-anomaly estimation system for the fluid machine.

BACKGROUND ART

In recent years, at chemical plants or power plants, introduction of technologies for state monitoring and diagnosis of plant equipment is underway for the purpose of achieving stable operation and streamlining maintenance work.

In a case where an anomaly has occurred in plant equipment, continuation of the operation, reduction of maintenance work time, and the like can be expected by sensing the anomaly of the plant equipment, and taking a measure promptly. For more effective implementation of a measure, in a case where an anomaly has occurred in plant equipment, a diagnostic technology for estimating the cause of the anomaly is important.

As an example of a facility diagnostic technology, for example, Patent Literature 1 describes an information processing device having, for more rightly making a diagnosis of a facility: a development pattern extraction unit that extracts a phenomenon pattern of a past sensor signal of the facility; an association unit that associates the sensor signal on the basis of maintenance history information; a classification criterion creation unit that creates a classification criterion for classifying the phenomenon pattern on the basis of the phenomenon pattern extracted by the development pattern extraction unit, and a work keyword included in the maintenance history information associated with the sensor signal from which the phenomenon pattern has been extracted; a phenomenon pattern classification unit that classifies the phenomenon pattern on the basis of the classification criterion created by the classification criterion creation unit; and a diagnostic model creation unit that creates a diagnostic model for estimating a work keyword to be presented to a maintenance worker on the basis of the phenomenon pattern classified by the phenomenon pattern classification unit, and the work keyword.

In addition, Patent Literature 2 describes a facility equipment fault diagnosis device including, for attempting to detect a wide range of causes of faults, reducing time of work for development of individual diagnostic schemes, and enhancing diagnose precision: at least one measurement means for measuring the operation state of facility equipment; a plurality of fault diagnosis means for analyzing a measurement result of the measurement means, and outputting a group of cause-of-fault candidates including one or more sets of cause-of-fault candidates and confidence factors thereof; and an integration means for integrating groups of cause-of-fault candidates each of which is output by one of the plurality of fault diagnosis means, and outputting a total diagnosis result.

On the other hand, Patent Literature 3 describes a rotating machine vibration diagnosis device including, for enhancing the confidence factor of a diagnosis result to be presented to an operating personnel, a controlling personnel, or an engineer of a remote monitoring service when a diagnosis of vibrations of a rotating machine is made: a diagnostic processing means for taking in various types of data obtained from the rotating machine, associating features of a plurality of vibration phenomena that occur in the rotating machine and a plurality of causes, and estimating a cause of the vibrations from a vibration causal matrix accumulated in a knowledge base; a memory having stored thereon in advance vibration analysis models corresponding to diagnosis results; a vibration analysis verification means for taking in the cause of the vibrations estimated by the diagnostic processing means, taking out an analysis model matching the cause of the vibrations from the memory, and performing an analysis; and a diagnosis result evaluation means for taking in an analysis verification result of the vibration analysis verification means, and the diagnosis result of the diagnostic processing means, and evaluating the occurrence of the vibration phenomenon.

CITATION LIST

Patent Literature

Patent Literature 1: Japanese Unexamined Patent Application Publication No. 2015-148867

Patent Literature 2: Japanese Unexamined Patent Application Publication No. 2007-293489

Patent Literature 3: Japanese Unexamined Patent Application Publication No. 2003-149043

SUMMARY OF INVENTION

Technical Problem

Meanwhile, a fluid machine such as a compressor has a structure in which a flow path where a fluid flows is provided in the casing of the fluid machine, and leakage of the fluid to the outside of the casing is prevented. Accordingly, it is difficult to install a sensor inside the fluid machine, and directly measure and monitor the internal state.

In a case where it is attempted to estimate the cause of an anomaly on the basis only of measurement values as described in Patent Literatures 1 to 3 mentioned above, there is a possibility that candidates of the cause of an anomaly related to changes of the internal state of a fluid machine cannot be narrowed down precisely for a reason that measurement values regarding the inside of the fluid machine cannot be obtained.

In addition, extraction of features of a vibration phenomenon as described in Patent Literature 3 typically requires frequency analysis in many cases, estimation of the cause of vibrations based on vibration causal matrices also is based on the premise that frequency components are known, and, for that purpose, measurement values need to be acquired at a high sampling frequency. There is a fear that constant monitoring of measurement values at a high sampling frequency leads to a cost increase of a measurement system or a data storage system.

The present invention has been made in view of the matters mentioned above, and an object thereof is to provide a cause-of-anomaly estimation device for a fluid machine, a cause-of-anomaly estimation method therefor, and a cause-of-anomaly estimation system for a fluid machine that enable simple and convenient, and highly precise estimation of the cause of an anomaly of a fluid machine.

Solution to Problem

In order to achieve the object described above, a cause-of-anomaly estimation device for a fluid machine according to the present invention is a cause-of-anomaly estimation device for a fluid machine that monitors a state of the fluid machine, and, in a case where there is an anomaly, estimates a cause of the anomaly. The cause-of-anomaly estimation device includes: a measurement value input unit to which measurement values obtained from one or more sensors installed in the fluid machine is input; a performance calculation unit that calculates performance of the fluid machine from the measurement value obtained by the measurement value input unit; an anomaly determination unit that determines presence or absence of an anomaly in the measurement value obtained by the measurement value input unit and in the performance of the fluid machine as calculated by the performance calculation unit; a cause-of-anomaly estimation unit that estimates a cause of an anomaly of the fluid machine on a basis of a determination result regarding the presence or absence of an anomaly in the performance of the fluid machine as determined by the anomaly determination unit, and a cause of an anomaly of the fluid machine estimated from a relationship between a cause of an anomaly of the fluid machine pre-stored in a cause-of-anomaly database, and a measurement value and performance correlated with occurrence of the anomaly; and a results output unit that outputs a cause-of-anomaly estimation result regarding the fluid machine as estimated by the cause-of-anomaly estimation unit.

The anomaly determination unit acquires a normally measured value and performance of the fluid machine pre-stored in a normally measured-value database, and determines whether or not there is an anomaly in the measurement value obtained by the measurement value input unit and in the performance as calculated by the performance calculation unit relative to the normally measured value and performance acquired from the normally measured-value database.

In addition, in order to achieve the object described above, a cause-of-anomaly estimation method for a fluid machine according to the present invention is a cause-of-anomaly estimation method for a fluid machine in which a state of a fluid machine is monitored, and, in a case where there is an anomaly, a causes of the anomaly are estimated. The cause-of-anomaly estimation method includes the steps of: inputting, to a measurement value input unit, measurement values obtained from one or more sensors installed in the fluid machine; by a performance calculation unit, calculating performance of the fluid machine from the measurement value obtained by the measurement value input unit; by an anomaly determination unit, determining presence or absence of an anomaly in the measurement value obtained by the measurement value input unit and in the performance of the fluid machine as calculated by the performance calculation unit; by a cause-of-anomaly estimation unit, estimating a cause of an anomaly of the fluid machine on a basis of a determination result regarding the presence or absence of an anomaly in the performance of the fluid machine as determined by the anomaly determination unit, and a cause of an anomaly of the fluid machine estimated from a relationship between a cause of an anomaly of the fluid machine pre-stored in a cause-of-anomaly database; and a measurement value and performance correlated with occurrence of the anomaly; thereafter outputting, to a results output unit, a cause-of-anomaly estimation result regarding the fluid machine as estimated by the cause-of-anomaly estimation unit.

by the anomaly determination unit, acquiring a normally measured value and performance of the fluid machine pre-stored in a normally measured-value database, and determining whether or not there is an anomaly in the measurement value obtained by the measurement value input unit and in the performance as calculated by the performance calculation unit relative to the normally measured value and performance acquired from the normally measured-value database.

In addition, in order to achieve the object described above, a cause-of-anomaly estimation system for a fluid machine according to the present invention is a cause-of-anomaly estimation system for a fluid machine in which measurement values of the fluid machine obtained by measurement by one or more sensors installed in the predetermined locations of the fluid machine is transferred to a cause-of-anomaly estimation device via a network, and a cause of an anomaly of the fluid machine as estimated by the cause-of-anomaly estimation device on a basis of the measurement value is notified to an owner of the fluid machine, in which the cause-of-anomaly estimation device is the cause-of-anomaly estimation device for a fluid machine with the configuration described above.

Advantageous Effects of Invention

The present invention enables simple and convenient, and highly precise estimation of the cause of an anomaly of a fluid machine.

BRIEF DESCRIPTION OF DRAWINGS

FIG. 3 is a figure depicting an example of measurement values in Embodiment 1 of the cause-of-anomaly estimation device for a fluid machine according to the present invention.

FIG. 4 is a figure depicting an example of a result of determination regarding the presence or absence of an anomaly by an anomaly determination unit in the Embodiment 1 of the cause-of-anomaly estimation device for a fluid machine according to the present invention.

FIG. 5 is a figure depicting an example of a cause-of-anomaly database in the Embodiment 1 of the cause-of-anomaly estimation device for a fluid machine according to the present invention.

DESCRIPTION OF EMBODIMENTS

Hereinbelow, on the basis of a depicted embodiment, a cause-of-anomaly estimation device for a fluid machine, a cause-of-anomaly estimation method therefor, and a cause-of-anomaly estimation system for a fluid machine according to the present invention are explained. Note that the same reference signs are used for identical constituent parts in different figures.

Embodiment 1

Figure 1:
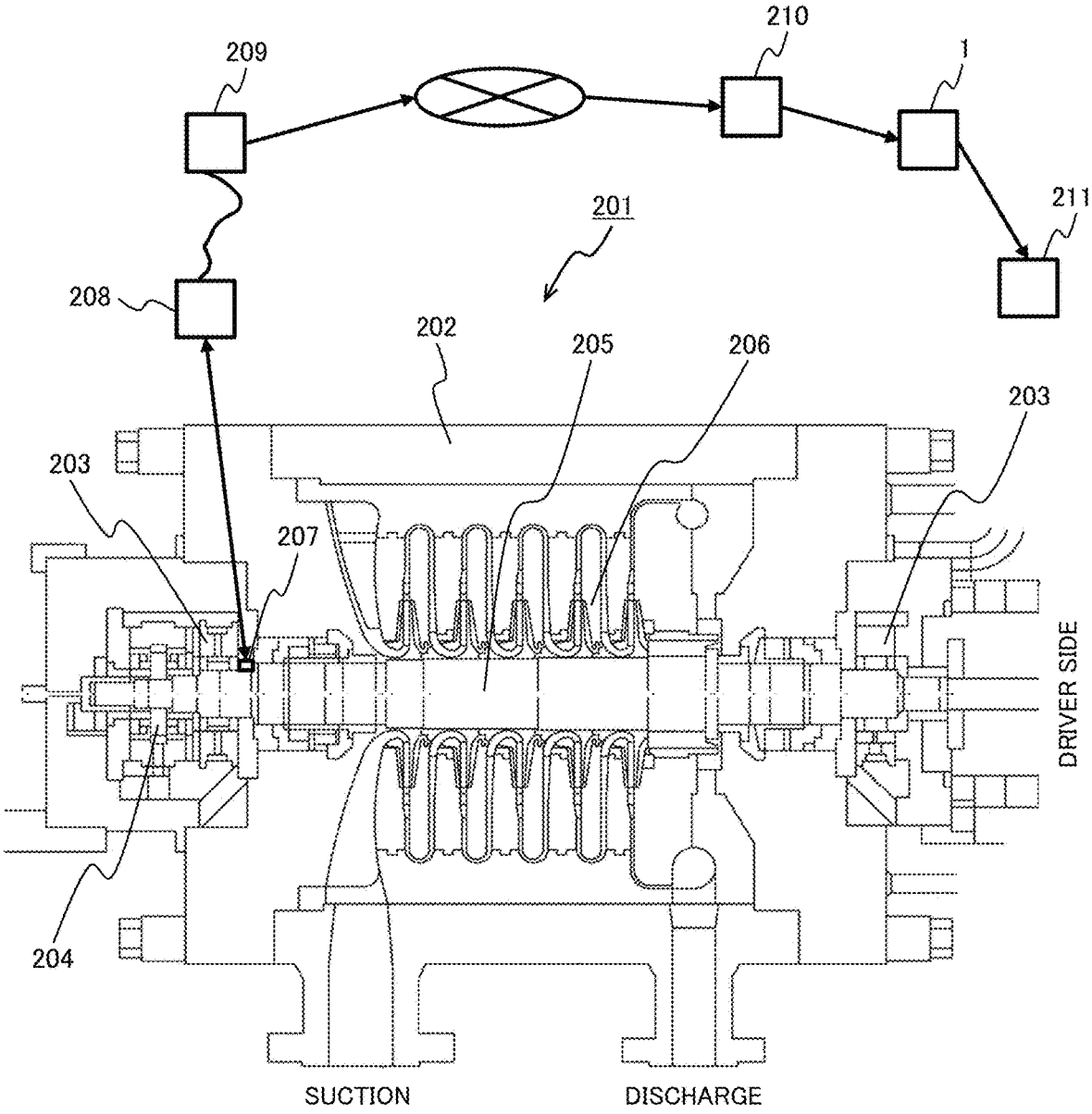
FIG. 1 is a figure depicting the overall configuration of a centrifugal compressor to which a cause-of-anomaly estimation device for a fluid machine according to the present invention is applied.

FIG. 1 depicts the overall configuration of a centrifugal compressor 201 to which a cause-of-anomaly estimation device for a fluid machine according to the present invention is applied.

As depicted in FIG. 1, the centrifugal compressor 201 generally includes: a casing 202 which is typically formed cylindrically, and serves as a stationary unit; a rotor 205 arranged in the casing 202; and two journal bearings 203 and a thrust bearing 204 rotatably supporting the rotor 205. The rotor 205 described above is provided with a plurality of impellers 206, and a fluid flowing in a flow path is compressed by rotation of the impellers 206.

In the centrifugal compressor 201 with the configuration described above, sensors for measuring the shaft vibration, suction temperature, discharge temperature, suction pressure, discharge pressure, rotation speed, and the like of the centrifugal compressor 201 are installed as appropriate at locations that are suited for the respective types of measurement.

A sensor 207 depicted in FIG. 1 is installed at the rotor 205 in order to measure the shaft vibration as an example, and is included in a cause-of-anomaly estimation system in which measurement values (shaft vibration) of the centrifugal compressor 201 obtained by measurement by the sensor 207 are transmitted to a monitoring system 210 via a network such as a DCS (distributed control system) 208 or a LAN 209, and are transferred from the monitoring system 210 to a cause-of-anomaly estimation device 1 that monitors the state of the centrifugal compressor 201, and, in a case where there is an anomaly, estimates the cause of the anomaly, and the cause of the anomaly of the centrifugal compressor 201 as estimated by the cause-of-anomaly estimation device 1 based on the measurement values obtained by measurement by the sensor 207 is notified to the owner (contract user) 211 of the centrifugal compressor 201.

Figure 2:
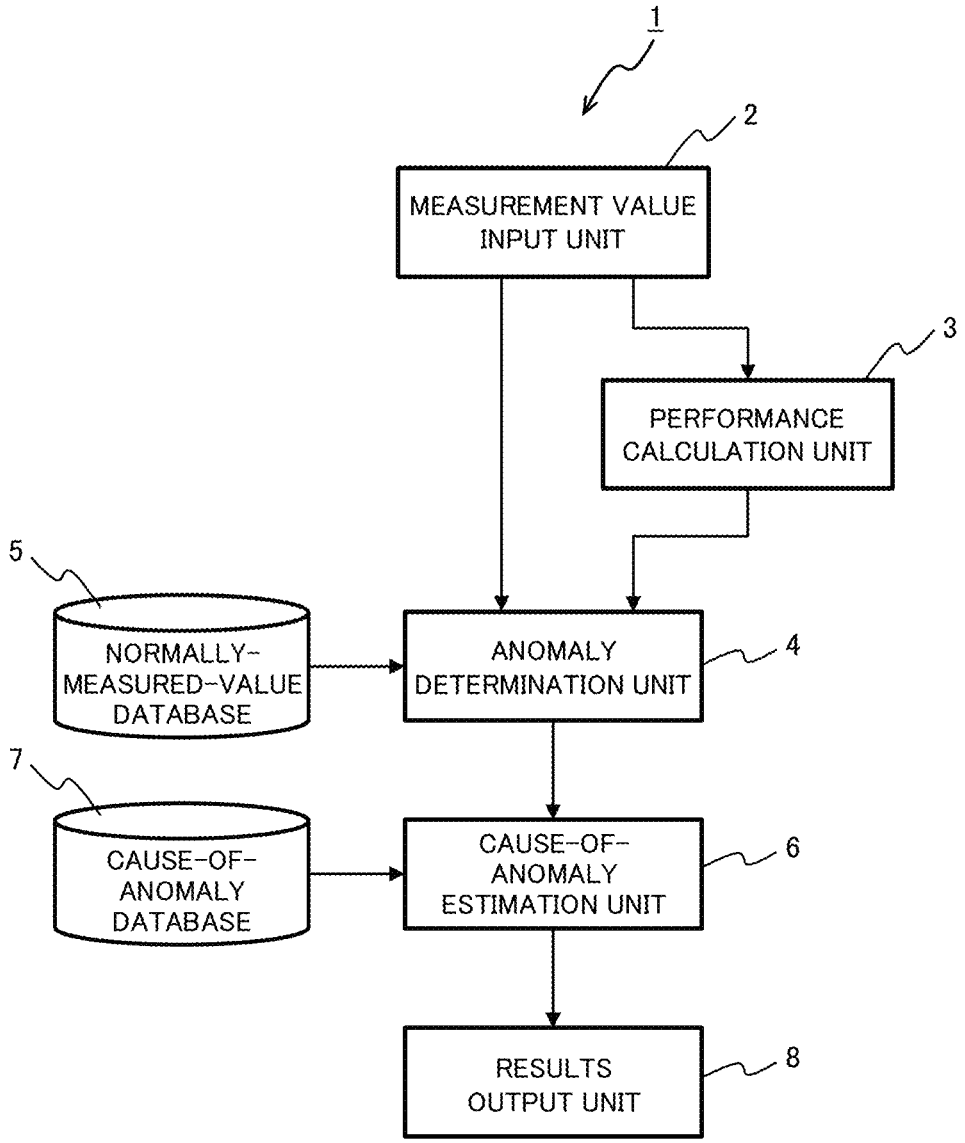
FIG. 2 is a figure depicting Embodiment 1 of a cause-of-anomaly estimation device for a fluid machine according to the present invention.

Next, the cause-of-anomaly estimation device 1 mentioned above is explained by using FIG. 2. FIG. 2 is a figure depicting Embodiment 1 of a cause-of-anomaly estimation device for a fluid machine according to the present invention.

As depicted in FIG. 2, the cause-of-anomaly estimation device 1 according to the present embodiment generally includes: a measurement value input unit 2 to which measurement values obtained from the sensor 207 installed in the centrifugal compressor 201 are input; a performance calculation unit 3 that calculates the performance of the centrifugal compressor 201 from the measurement values obtained by the measurement value input unit 2; an anomaly determination unit 4 that determines the presence or absence of an anomaly in the measurement values obtained by the measurement value input unit 2 and in the performance of the centrifugal compressor 201 as calculated by the performance calculation unit 3; a cause-of-anomaly estimation unit 6 that estimates the cause of an anomaly of the centrifugal compressor 201 on the basis of a determination result regarding the presence or absence of an anomaly in the performance of the centrifugal compressor 201 as determined by the anomaly determination unit 4, and the causes of anomalies of the centrifugal compressor 201 pre-stored in a cause-of-anomaly database 7; and a results output unit 8 that outputs a cause-of-anomaly estimation result regarding the centrifugal compressor 201 as estimated by the cause-of-anomaly estimation unit 6. Note that the reference sign 5 denotes a normally-measured-value database in which normally-measured values and performance of the centrifugal compressor 201 are stored.

In FIG. 2, measurement values of the shaft vibration, suction temperature, discharge temperature, suction pressure, discharge pressure, rotation speed, and the like obtained from the sensor 207 installed in the centrifugal compressor 201 are input to the measurement value input unit 2 (FIG. 3 depicts an example of measurement values input to the measurement value input unit 2, and measurement values obtained at each time are input to the measurement value input unit 2).

In addition, the performance calculation unit 3 calculates the performance from some of the measurement values obtained by the measurement value input unit 2, and, in the present embodiment, the polytropic efficiency of the centrifugal compressor 201 is calculated as the performance from measurement values of the suction temperature, suction pressure, discharge temperature, discharge pressure, and gas composition obtained by measurement by the sensor 207.

Note that whereas the polytropic efficiency is used as the performance of the centrifugal compressor 201 in the present example, this is not the sole example. For example, similar advantageous effects can be achieved by using, instead of the polytropic efficiency, an index representing the performance of the centrifugal compressor 201 such as the polytropic head or the axial power.

In addition, the anomaly determination unit 4 has a function to determine whether or not there is an anomaly in the measurement values obtained from the sensor 207 and input to the measurement value input unit 2 and in the polytropic efficiency (performance) as calculated by the performance calculation unit 3.

An anomaly in the measurement values of the sensor 207 and in the performance means a deviation of the measurement values of the sensor 207, and of the performance from a predetermined normal range, and implies a possibility that normal functions of the centrifugal compressor 201 will be lost or have been lost.

In addition, the anomaly determination unit 4 acquires, from the normally-measured-value database 5, the pre-stored normally-measured values and performance of the centrifugal compressor 201, and determines whether or not there is an anomaly in the measurement values obtained by measurement by the sensor 207 and in the polytropic efficiency (performance) as calculated by the performance calculation unit 3 relative to the normally-measured values and performance acquired from the normally-measured-value database 5.

Whereas, for example, the Mahalanobis-Taguchi method is used for such a process performed by the anomaly determination unit 4, this is not the sole example.

FIG. 4 depicts an example of a result of the determination regarding the presence or absence of an anomaly of the centrifugal compressor 201 by the anomaly determination unit 4, and depicts a case where it is determined that there is an anomaly in the measurement values of the shaft vibration input to the measurement value input unit 2 and in the polytropic efficiency calculated by the performance calculation unit 3 from the measurement values of the suction temperature, suction pressure, discharge temperature, discharge pressure, and gas composition. An anomaly determination result as determined by the anomaly determination unit 4 is output to the cause-of-anomaly estimation unit 6.

In addition, a relationship between the causes of anomalies of the centrifugal compressor 201 and measurement values and performance correlated with occurrence of the anomalies is pre-stored in the cause-of-anomaly database 7; on the other hand, the cause-of-anomaly estimation unit 6 has a function to estimate the cause of an anomaly of the centrifugal compressor 201 on the basis of the anomaly determination result received from the anomaly determination unit 4.

That is, the cause-of-anomaly estimation unit 6 estimates the cause of an anomaly of the centrifugal compressor 201 from the input anomaly determination result of the anomaly determination unit 4, and the relationship between the causes of anomalies of the centrifugal compressor 201 pre-stored in the cause-of-anomaly database 7, and measurement values and performance correlated with occurrence of the anomalies.

Whereas, as such a process performed by the cause-of-anomaly estimation unit 6, for example, a method in which causal relationships are ordered on a directed acyclic graph structure, and the probability of occurrence of each cause of an anomaly is inferred from the presence or absence of an anomaly is used, this is not the sole example.

FIG. 5 depicts an example of the cause-of-anomaly database 7 related to the present implementation embodiment.

By using, for cause estimation, not only measurement values, but also the presence or absence of an anomaly in the polytropic efficiency depicted in FIG. 5, the cause of an anomaly can be estimated taking into consideration the internal state of the centrifugal compressor 201, which cannot be measured directly by the sensor 207.

Figure 6:
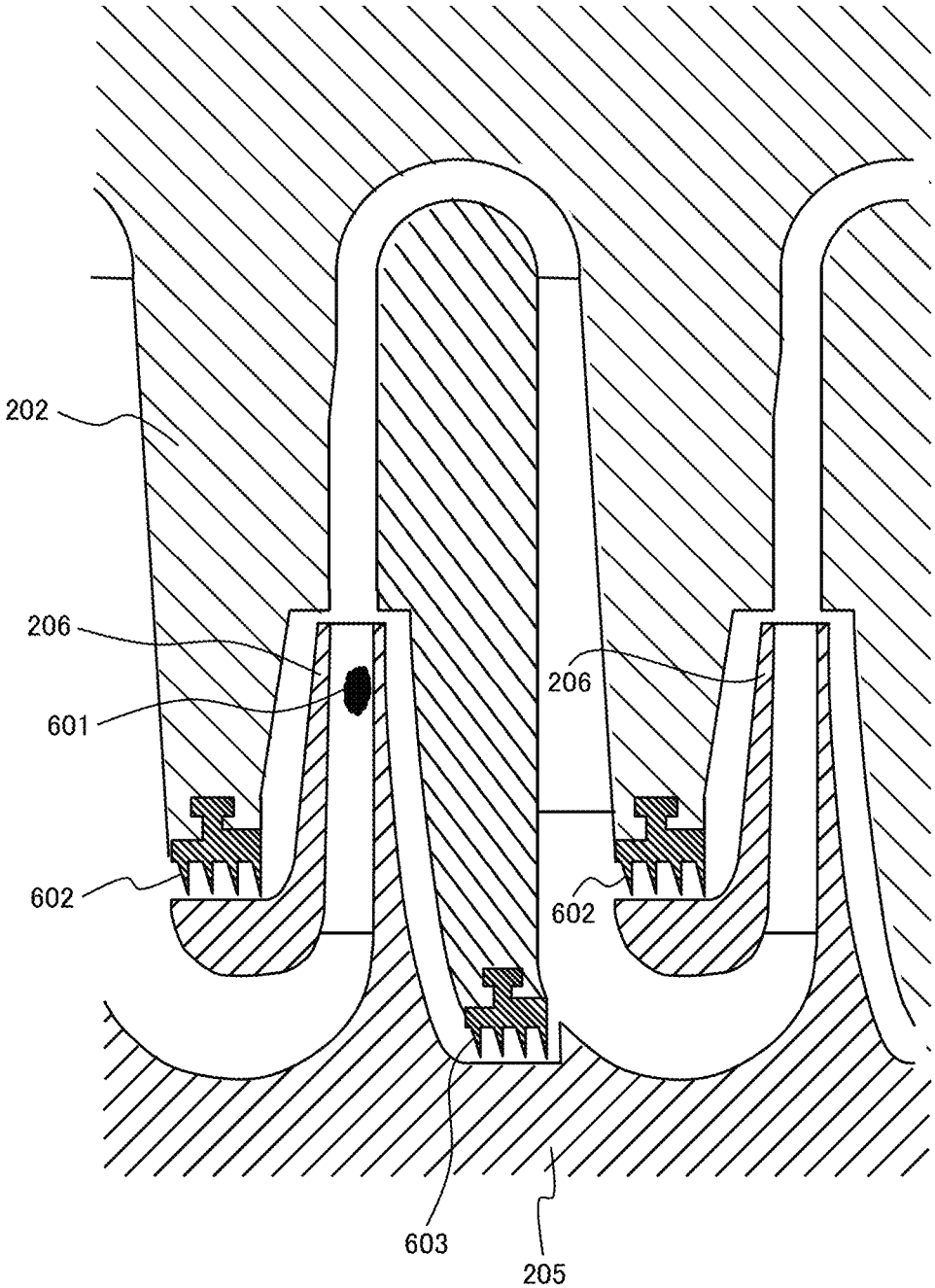
FIG. 6 is an enlarged cross-sectional view of the vicinity of impellers of the centrifugal compressor depicted in FIG. 1.

For example, in a case depicted in FIG. 5 where it is determined that there are anomalies in the shaft vibration and the polytropic efficiency, it is suspected that part of the flow path through the impellers 206 is contaminated. That is, as depicted in FIG. 6 as an enlarged view of the vicinity of the impellers 206, in a case where it is determined that there are anomalies in the shaft vibration and the polytropic efficiency, it can be estimated that there is flow path contamination 601 of the impellers 206, an imbalance of the rotor 205 has increased, and an anomaly has occurred in the shaft vibration.

In addition, in a case depicted in FIG. 5 where it is determined that there are anomalies in the axial movement, and the temperature and polytropic efficiency of the thrust bearing 204, it is suspected that the pressure balance in the centrifugal compressor 201 has changed. That is, in a case where it is determined that there are abnormalities in the axial movement, and the temperature and polytropic efficiency of the thrust bearing 204, in FIG. 6, it can be estimated that a candidate of the cause of the anomalies is an increase of internal leakage due to degradation of an eye seal unit 602 or an interstage seal unit 603 that prevents a gas from flowing from the high-pressure side to the low-pressure side through a gap between the impellers 206, and the casing 202 and the rotor 205, or a balance drum seal unit (not depicted).

In addition, the anomaly determination result regarding the measurement values and the performance, and the estimated cause of the anomaly from the cause-of-anomaly estimation unit 6 are input to the results output unit 8, and a graph or a table as a diagnosis result is output-displayed.

Figure 7:
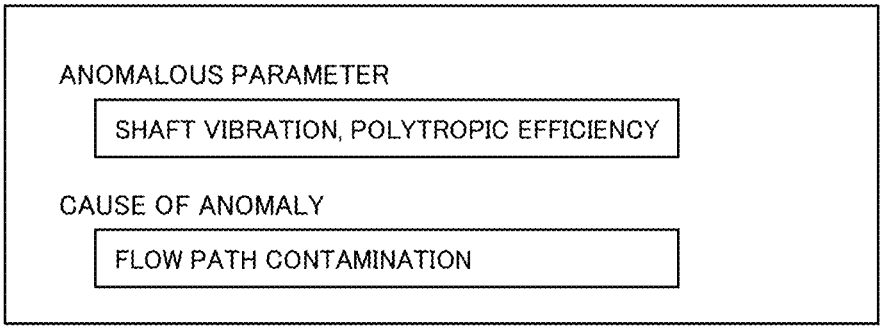
FIG. 7 is a figure depicting an example of a diagnosis result output-displayed on a results output unit in Embodiment 1 of the cause-of-anomaly estimation device for a fluid machine according to the present invention.

FIG. 7 depicts an example of the diagnosis result output-displayed on results output unit 8. The shaft vibration and the polytropic efficiency are output-displayed as abnormal parameters, and the flow path contamination as the cause of the anomaly at that time is output-displayed.

According to the present implementation embodiment like this, regarding cause-of-anomaly candidates from which the cause of an anomaly cannot be singled out in a case where the cause of the anomaly is estimated on the basis only of the presence or absence of an anomaly in measurement values obtained from the sensor 207 (the cause of the anomaly is estimated taking into consideration the internal state of the centrifugal compressor 201, which cannot be directly measured with the sensor 207, by using, for cause estimation, not only the measurement values, but also the presence or absence of an anomaly in the polytropic efficiency), by estimating the cause of the anomaly on the basis of an anomaly in the measurement values, and deterioration of the performance calculated from the measurement values (degradation of the polytropic efficiency), it becomes possible to narrow down the cause-of-anomaly candidates taking into consideration degradation of the internal state of the centrifugal compressor 201, and it is possible to simply and conveniently, and more highly precisely estimate the cause of the anomaly of the centrifugal compressor 201.

It should be noted that the present invention is not limited to the embodiments described above, and includes various modification examples.

For example, the embodiment described above is explained in detail in order to explain the present invention in an easy-to-understand manner, and are not necessarily limited to those including all the constituent elements explained. In addition, some or all of the constituent elements, functions and the like described above may be realized by designing them, for example, in an integrated circuit, and so on. In addition, the constituent elements, functions and the like described above may be realized by software by a processor interpreting and executing a program to realize the functions.

REFERENCE SIGNS LIST

1: cause-of-anomaly estimation device, 2: measurement value input unit, 3: performance calculation unit, 4: anomaly determination unit, 5: normally-measured-value database, 6: cause-of-anomaly estimation unit, 7: cause-of-anomaly database, 8: results output unit, 201: centrifugal compressor, 202: casing, 203: journal bearing, 204: thrust bearing, 205: rotor, 206: impeller, 207: sensor, 208: DCS (distributed control system), 209: LAN, 210: monitoring system, 211: owner of centrifugal compressor, 601: flow path contamination, 602: eye seal unit, 603: interstage seal unit

The invention claimed is:

1. A cause-of-anomaly estimation device for a fluid machine that monitors a state of the fluid machine, and, in a case where there is an anomaly, estimates a cause of the anomaly, the cause-of-anomaly estimation device comprising:

a measurement value input unit to which measurement values obtained from one or more sensors installed in the fluid machine is input;

a performance calculation unit that calculates performance of the fluid machine from the measurement value obtained by the measurement value input unit;

an anomaly determination unit that determines presence or absence of an anomaly in the measurement value obtained by the measurement value input unit and in the performance of the fluid machine as calculated by the performance calculation unit;

a cause-of-anomaly estimation unit that estimates a cause of an anomaly of the fluid machine on a basis of a determination result regarding the presence or absence of an anomaly in the performance of the fluid machine as determined by the anomaly determination unit, and a cause of an anomaly of the fluid machine estimated from a relationship between a cause of an anomaly of the fluid machine pre-stored in a cause-of-anomaly database, and a measurement value and performance correlated with occurrence of the anomaly; and a results output unit that outputs a cause-of-anomaly estimation result regarding the fluid machine as estimated by the cause-of-anomaly estimation unit, wherein the anomaly determination unit acquires a normally measured value and performance of the fluid machine pre-stored in a normally measured-value database, and determines whether or not there is an anomaly in the measurement value obtained by the measurement value input unit and in the performance as calculated by the performance calculation unit relative to the normally measured value and performance acquired from the normally measured-value database.

2. The cause-of-anomaly estimation device for a fluid machine according to claim 1, wherein efficiency is used as an index representing the performance of the fluid machine.

3. The cause-of-anomaly estimation device for a fluid machine according to claim 2, wherein any of polytropic efficiency, polytropic head, and axial power is used as the efficiency of the fluid machine.

4. The cause-of-anomaly estimation device for a fluid machine according to claim 3, wherein the fluid machine is a centrifugal compressor including: a cylindrically-formed casing; a rotor arranged in the casing; and a journal bearing and a thrust bearing rotatably supporting the rotor, the rotor being provided with a plurality of impellers, a fluid flowing in a flow path being compressed by rotation of the impellers, and in a case where it is determined that there is an anomaly in shaft vibration of the centrifugal compressor obtained by measurement by the sensor and input to the measurement value input unit and in the polytropic efficiency, the polytropic head, or the axial power calculated by the performance calculation unit from suction temperature, suction pressure, discharge temperature, discharge pressure, or gas composition of the centrifugal compressor, it is estimated that part of the flow path through the impellers is contaminated, and an anomaly has occurred in the shaft vibration.

5. The cause-of-anomaly estimation device for a fluid machine according to claim 3, wherein the fluid machine is a centrifugal compressor including: a cylindrically-formed casing; a rotor arranged in the casing; and a journal bearing and a thrust bearing rotatably supporting the rotor, the rotor being provided with a plurality of impellers, a fluid flowing in a flow path being compressed by rotation of the impellers, and in a case where it is determined that there is an anomaly in axial movement of the centrifugal compressor and in temperature of the thrust bearing and the polytropic efficiency, the polytropic head, or the axial power, it is estimated that a candidate of a cause of the anomaly is an increase of internal leakage due to degradation of an eye seal unit or an interstage seal unit that prevents a gas from flowing from a high-pressure side to a low-pressure side through a gap between the impellers, and the casing and the rotor, or a balance drum seal unit.

6. A cause-of-anomaly estimation system for a fluid machine in which measurement values of the fluid machine obtained by measurement by one or more sensors installed in the predetermined locations of the fluid machine is transferred to a cause-of-anomaly estimation device via a network, and a cause of an anomaly of the fluid machine as estimated by the cause-of-anomaly estimation device on a basis of the transferred measurement value is notified to an owner of the fluid machine, wherein the cause-of-anomaly estimation device is the cause-of-anomaly estimation device for a fluid machine according to claim 1.

7. A cause-of-anomaly estimation method for a fluid machine in which a state of a fluid machine is monitored, and, in a case where there is an anomaly, a cause of the anomaly is estimated, the cause-of-anomaly estimation method comprising:

inputting, to a measurement value input unit, a measurement value obtained from a sensor installed in the fluid machine;

by a performance calculation unit, calculating performance of the fluid machine from the measurement value obtained by the measurement value input unit;

by an anomaly determination unit, determining presence or absence of an anomaly in the measurement value obtained by the measurement value input unit and in the performance of the fluid machine as calculated by the performance calculation unit;

by a cause-of-anomaly estimation unit, estimating a cause of an anomaly of the fluid machine on a basis of a determination result regarding the presence or absence of an anomaly in the performance of the fluid machine as determined by the anomaly determination unit, and a cause of an anomaly of the fluid machine estimated from a relationship between a cause of an anomaly of the fluid machine pre-stored in a cause-of-anomaly database, and a measurement value and performance correlated with occurrence of the anomaly;

thereafter outputting, to a results output unit, a cause-of-anomaly estimation result regarding the fluid machine as estimated by the cause-of-anomaly estimation unit; and by the anomaly determination unit, acquiring a normally measured value and performance of the fluid machine pre-stored in a normally measured-value database, and determining whether or not there is an anomaly in the measurement value obtained by the measurement value input unit and in the performance as calculated by the performance calculation unit relative to the normally measured value and performance acquired from the normally measured-value database.

8. The cause-of-anomaly estimation method for a fluid machine according to claim 7, wherein efficiency is used as an index representing the performance of the fluid machine.

9. The cause-of-anomaly estimation method for a fluid machine according to claim 8, wherein any of polytropic efficiency, polytropic head, and axial power is used as the efficiency of the fluid machine.

* * * * *